US008995860B2

(12) United States Patent
Akiya

(10) Patent No.: US 8,995,860 B2
(45) Date of Patent: Mar. 31, 2015

(54) IMAGE FIXING APPARATUS HAVING END REGION TEMPERATURE CONTROL

(71) Applicant: Canon Kabushiki Kaisha, Tokyo (JP)

(72) Inventor: Keigo Akiya, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 88 days.

(21) Appl. No.: 13/785,917

(22) Filed: Mar. 5, 2013

(65) Prior Publication Data

US 2013/0236202 A1 Sep. 12, 2013

(30) Foreign Application Priority Data

Mar. 9, 2012 (JP) ..... 2012-053583

(51) Int. Cl.
*G03G 15/20* (2006.01)
*G03G 21/20* (2006.01)

(52) U.S. Cl.
CPC ..... *G03G 21/206* (2013.01); *G03G 15/2017* (2013.01); *G03G 15/2042* (2013.01); *G03G 2215/2035* (2013.01)
USPC ..... 399/69; 399/334

(58) Field of Classification Search
CPC ..... G03G 15/2017; G03G 15/2021; G03G 15/2046; G03G 21/206; G03G 2221/1639; G03G 2221/1645
USPC ..... 399/33, 69, 92, 320, 328, 334; 219/216
See application file for complete search history.

(56) References Cited

U.S. PATENT DOCUMENTS

| | | | | |
|---|---|---|---|---|
| 5,787,321 | A * | 7/1998 | Nishikawa et al. | 399/69 |
| 7,609,991 | B2 * | 10/2009 | Koshida | 399/92 |
| 7,860,418 | B2 * | 12/2010 | VanKouwenberg et al. | 399/69 |
| 8,254,802 | B2 * | 8/2012 | Hanashi et al. | 399/92 |
| 8,351,833 | B2 * | 1/2013 | Koshida | 399/328 |
| 8,646,893 | B2 * | 2/2014 | Ramesh et al. | 347/88 |
| 8,725,025 | B2 * | 5/2014 | Murasaki | 399/92 |
| 2013/0011157 | A1 * | 1/2013 | Kaino et al. | 399/92 |

FOREIGN PATENT DOCUMENTS

| | | | |
|---|---|---|---|
| JP | 2008-032904 | A | 2/2008 |
| JP | 2008-040235 | A | 2/2008 |
| JP | 2008-058378 | A | 3/2008 |
| JP | 2009300856 | A * | 12/2009 |
| JP | 2011-107219 | A | 6/2011 |

* cited by examiner

*Primary Examiner* — Robert Beatty
(74) *Attorney, Agent, or Firm* — Canon USA Inc. IP Division

(57) ABSTRACT

The present invention relates to an image fixing apparatus including a fan for cooling one end region of the image fixing apparatus and a fan for cooling another end region thereof. When a temperature of the one end region reaches a cooling starting temperature, a fan corresponding to the one end portion is driven at a first rotation speed, and another fan is driven at a second rotation speed lower than the first rotation speed even if the temperature of the other end region is lower than the cooling starting temperature so as to protect the fans from thermal damages.

10 Claims, 18 Drawing Sheets

FIG.6

SHUTTER POSITION SETTING TABLE

| PAPER SIZE | A GROUP | B GROUP | C GROUP |
|---|---|---|---|
| | A3 SHORT EDGE FEED<br>A4 LONG EDGE FEED | LTR LONG EDGE FEED<br>B5 LONG EDGE FEED | LTR SHORT EDGE FEED<br>A4 SHORT EDGE FEED<br>ENVELOPE SHORT EDGE FEED |
| SHUTTER POSITION | CLOSED | POSITION A | POSITION B |

FIG.14

FAN DRIVING VOLTAGE SETTING TABLE

| HEATER CURRENT VALUE | PAPER SIZE | | | |
|---|---|---|---|---|
| | I GROUP | II GROUP | III GROUP | IV GROUP |
| | A3 SHORT EDGE FEED<br>A4 LONG EDGE FEED | LTR LONG EDGE FEED<br>B5 LONG EDGE FEED | LTR SHORT EDGE FEED<br>A4 LONG EDGE FEED | ENVELOPE<br>SHORT EDGE FEED |
| Ifd < 5A | STOP | 10V | 10V | 10V |
| 5A ≤ Ifd < 7A | STOP | 10V | 10V | 15V |
| 7A ≤ Ifd < 9A | STOP | 10V | 15V | 15V |
| 9A ≤ Ifd < 11A | STOP | 15V | 15V | 22V |
| 11A ≤ Ifd | STOP | 15V | 22V | 22V |

IMAGE FIXING APPARATUS HAVING END REGION TEMPERATURE CONTROL

BACKGROUND OF THE INVENTION

1. Field of the Invention

The present invention relates to an image fixing apparatus mounted on an image forming apparatus, such as a copy machine and a printer, that adopts an electrophotographic method or an electrostatic recording method and forms an image on a recording material.

2. Description of the Related Art

In an image fixing apparatus for heating and fixing toner onto a recording material, when the recording material on which fixing processing is performed is small in size, it is known that a phenomenon (a rise of a temperature of a non-paper-passing portion) occurs in which a temperature of an end region where the recording material does not pass rises. In particular, the phenomenon frequently occurs in the image fixing apparatus with a film fixing method, in which a heat capacity of a heating-rotatable member is reduced for purpose of saving energy.

As one of measures against the rise of the temperature of the non-paper-passing portion, it is known that a cooling fan for cooling the non-paper-passing portion is provided. Japanese Patent Application Laid-Open No. 2008-058378 discusses that shutters moving according to a size of the recording material and an element for detecting the temperature of the non-paper-passing region portion of the fixing member are provided so as to adjust air volume by a cooling fan according to the detected temperature. Since the two shutters are moved by one motor, the apparatus can be simplified.

However, in the image fixing apparatus equipped with a cooling system for supplying air to the non-paper-passing portion in the image fixing apparatus by providing the cooling fan, when the above-described simplified apparatus is applied, the problems may occur as below.

FIG. 1A illustrates a schematic configuration of an image fixing device with a film fixing method including cooling fans and distribution of the temperatures of a ceramic heater. FIG. 1A illustrates a recording paper P, a heating portion 301 of the ceramic heater, and cooling fans 222 and 232. The recording paper P is conveyed with reference to a broken line B (conveyance reference) passing at a center of the ceramic heater in a longitudinal direction.

An amount of heat generation by the ceramic heater is adjusted based on a result acquired by a temperature detection element Th1 (illustrated in FIG. 4) provided at a point Q of a center portion of the ceramic heater. The point Q of the center portion of the ceramic heater is controlled to maintain a desired temperature (a target temperature). A solid line K indicates the distribution of the temperature of the ceramic heater when the amount of the heat generation at end portions C and D of the ceramic heater varies or when the recording paper P to be passed passes as being set closer to the end portion D side. The broken line J indicates that the recording paper P continuously passes while the state indicated by the solid line K is maintained. As illustrated in FIG. 1A, the variation in the amount of the heat generation at the end portions C and D of a heating portion 301 of the ceramic heater, and an amount of shifting from the point Q of the center portion of a path where the recording paper P passes cause a difference in the distribution of the temperature at the end portions C and D. The greater the amount of the variation and the amount of the shifting become, the larger the difference between the temperatures at the non-paper-passing portions G and H becomes. At this point, when the temperature of either one of the end portions C and D exceeds a threshold value T, a shutter is moved by a driving unit that can be used for both right and left shutters. At the same time, the cooling fan for cooling the one end portion starts cooling.

However, when the temperature of the other end portion does not need to be cooled at this point, even if the cooling fan is stopped, the shutter is opened with reference to the raising temperature of the one end portion. Consequently, heated air around the fixing device proceeds from an opening portion to the cooling fan out of operation via a duct, to raise the temperature of components included in the cooling fan. Thus, the cooling fan may be damaged or characteristics of the cooling fan may be significantly deteriorated. Further, since the duct for supplying air is reduced in length due to the reduced size of the device, the device is readily further impacted by the heated air around the image fixing device. To avoid the above-described problem, the driving unit for moving the shutters may be divided in two. However, that may complicate the device and raise costs.

Further, a detection unit may be provided for detecting an ambient temperature of the cooling fan. However, that also raises the costs.

SUMMARY OF THE INVENTION

The present invention provides an image fixing apparatus capable of protecting components included in a cooling fan from being damaged with heat.

According to an aspect of the present invention, an image fixing apparatus includes a fixing unit configured to heat and fix, onto a recording material, an unfixed image formed on the recording material, a first temperature detection element configured to detect a temperature of one end region in the fixing unit where a standard recording material does not pass that has a smallest width and is available for the apparatus, a second temperature detection element configured to detect a temperature of another end region in the fixing unit, a first fan configured to cool the one end region by starting to be driven when the temperature detected by the first temperature detection element reaches a cooling starting temperature, a second fan configured to cool the other end region by starting to be driven when the temperature detected by the second temperature detection element reaches a cooling starting temperature, a first shutter configured to change a width to be cooled by the first fan, and a second shutter configured to change a width to be cooled by the second fan, the second shutter moves in conjunction with the first shutter, wherein the apparatus is configured to drive the first and second shutters according to a size of the recording material to change the widths to be cooled by the first and second fans, and wherein, if the temperature of the one end region is different from that of the another end region during fixing processing, when the temperature detected by the temperature detection element corresponding to one of the first and second fans corresponding to one end region where the temperature is higher reaches the cooling starting temperature, the one fan is driven at a first rotation speed, and, when the temperature detected by the temperature detection element corresponding to another fan is within a temperature range lower than the cooling starting temperature while the one fan is being driven at the first rotation speed, the other fan is driven at a second rotation speed lower than the first rotation speed.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 6 is a table illustrating shutter positions according to the first exemplary embodiment.

FIG. 14 is a table of setting a cooling fan driving voltage according to the first exemplary embodiment.

DESCRIPTION OF THE EMBODIMENTS

Various exemplary embodiments, features, and aspects of the invention will be described in detail below with reference to the drawings.

Figure 2:
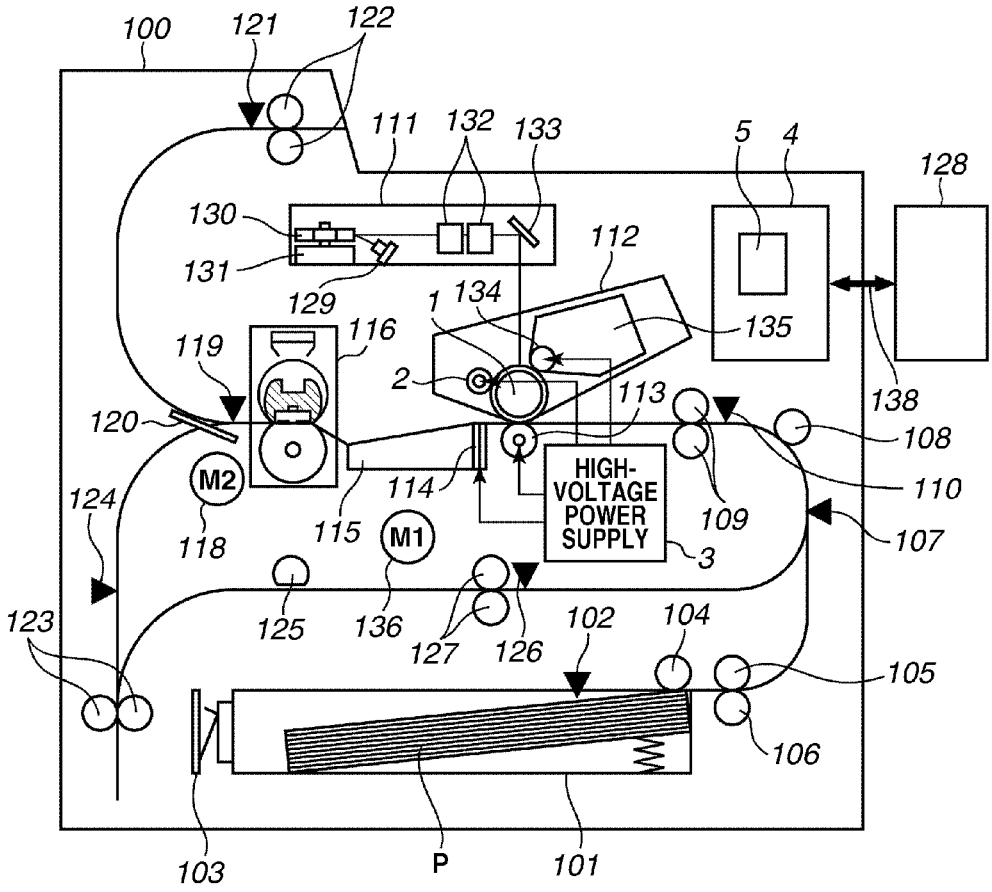
FIG. 2 illustrates an entire configuration of an image forming apparatus equipped with the image fixing apparatus according to the first exemplary embodiment.

The first exemplary embodiment will be described below. FIG. 2 illustrates a configuration of a laser beam printer 100 equipped with an image fixing apparatus according to an exemplary embodiment of the present invention. The laser beam printer 100 includes a deck 101 storing a recording paper (a recording material) P, a deck paper presence sensor 102 detecting whether the recording paper P is present in the deck 101, and a paper size detection sensor 103 detecting a size of the recording paper P in the deck 101. Further, the laser beam printer 100 includes a pick-up roller 104 for sending out the recording paper P from the deck 101, a deck paper-feeding roller 105 for conveying the sent-out recording paper P, and a retard roller 106 paired with the deck paper-feeding roller 105 and preventing a plurality of sheets of the recording paper P from being double fed.

Downstream of the deck paper-feeding roller 105, there is provided a paper feeding sensor 107 that detects a state of paper fed and conveyed from the deck 101 and a two-sided reversing unit described below. A paper-feeding conveyance roller 108 for further conveying the recording paper P downstream, a registration roller pair 109 for conveying the recording paper P in synchronization with print timing, and a pre-registration sensor 110 detecting a conveyance state of the recording paper P to the registration roller pair 109 are disposed. Downstream of the registration roller pair 109, a laser scanner unit 111 emitting a laser beam based on image information from a video controller 128, and a process cartridge 112 including a photosensitive drum 1 to be exposed by the laser beam from the laser scanner unit 111 are disposed.

A roller member 113 (referred to as a "transfer roller", hereinafter) for transferring a toner image formed on the photosensitive drum 1 onto the recording paper P, and a discharging member 114 (referred to as a "static charge eliminator", hereinafter) for removing a charge on the recording paper P to facilitate separation of the recording paper P from the photosensitive drum 1 are disposed. Downstream of the static charge eliminator 114, a conveyance guide 115, an image fixing apparatus 116 heating and fixing the toner image transferred onto the recording paper P, and a fixed paper discharge sensor 119 detecting a conveyance state from the image fixing apparatus 116 are disposed. Further, a two-sided flapper 120 for switching destinations of the recording paper P conveyed from the image fixing apparatus 116 between a paper-discharge unit and a two-sided reversing unit is disposed.

Further, downstream of the paper-discharge unit, a paper discharge sensor 121 detecting a paper conveyance state of the paper-discharge unit, and a paper-discharge roller pair 122 for discharging the recording paper P are disposed. On the other hand, the two-sided reversing unit is disposed that reverses the recording paper P, on which one-side printing has been performed, between a front and a back thereof to perform printing on the both sides of the recording paper P. Then, the two-sided reversing unit feeds the paper to the image forming unit again. At a side of the two-sided reversing unit, a reversing roller pair 123 for switchbacking the recording paper P by forward and reverse rotations, and a reverse sensor 124 detecting the paper conveyance state to the reversing roller 123 are provided.

A D-cut roller 125 for conveying the recording paper P from a lateral registration unit (not illustrated) to align a position of the recording paper P in a lateral direction, and a two-sided sensor 126 detecting a recording paper P conveyance state in the two-sided reversing unit. Further, a two-sided conveyance roller pair 127 is disposed that conveys the recording paper P from the two-sided reversing unit to the paper feeding unit. A series of control of the image forming apparatus 100 is performed by a central processing unit (CPU) 5 mounted on an engine controller 4.

(Fixing Apparatus)

Figure 1A:
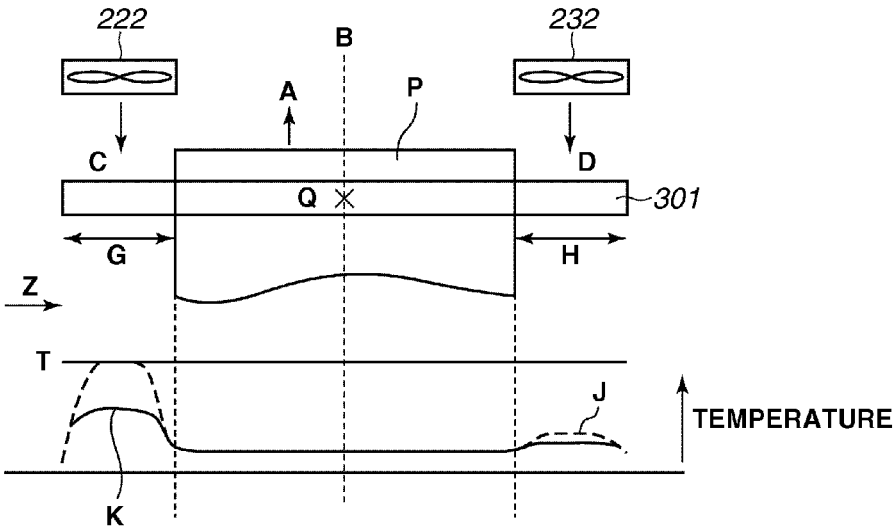
FIG. 1A illustrates an issue, and FIG. 1B schematically illustrates an image fixing apparatus according to a first exemplary embodiment.
Figure 1B:
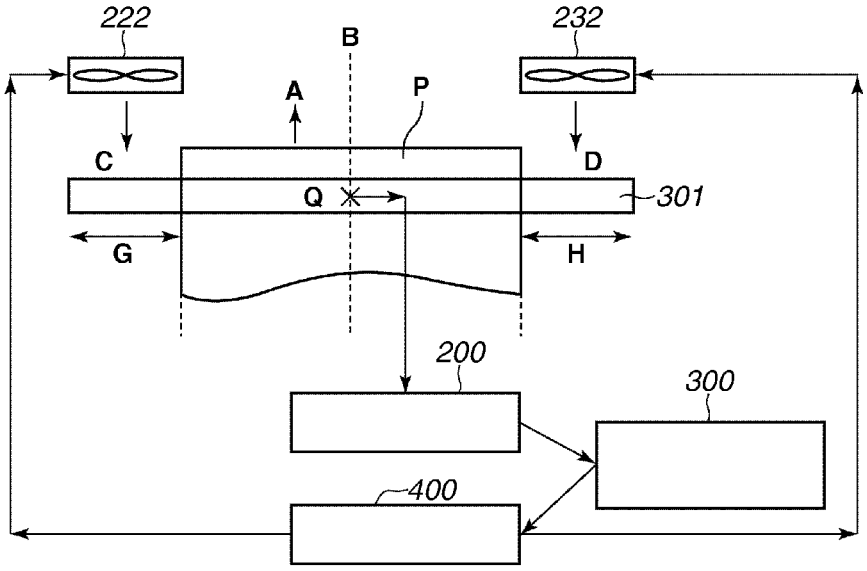

FIG. 1B is a top plan view illustrating an image fixing apparatus according to the present exemplary embodiment. The fixing apparatus includes, to be described below, a fixing film, a pressing roller, and a fixing unit fixing an unfixed image formed on the recording material onto the recording material. The recording paper P is passed in an A direction. In a ceramic heater, a power is controlled so that the detected temperature by a thermistor Th1 (illustrated in FIG. 4) located at a center portion Q in the longitudinal direction of the heater maintains a target temperature. A current detection circuit 200 detects a current flowing through the heater. A driving voltage setting unit 300 sets a first driving voltage (a first rotation speed) of the cooling fan corresponding to the current detected by the current detection circuit 200. A fan control unit 400 controls the cooling fan corresponding to a setting value of the driving voltage setting unit 300.

Figure 3:
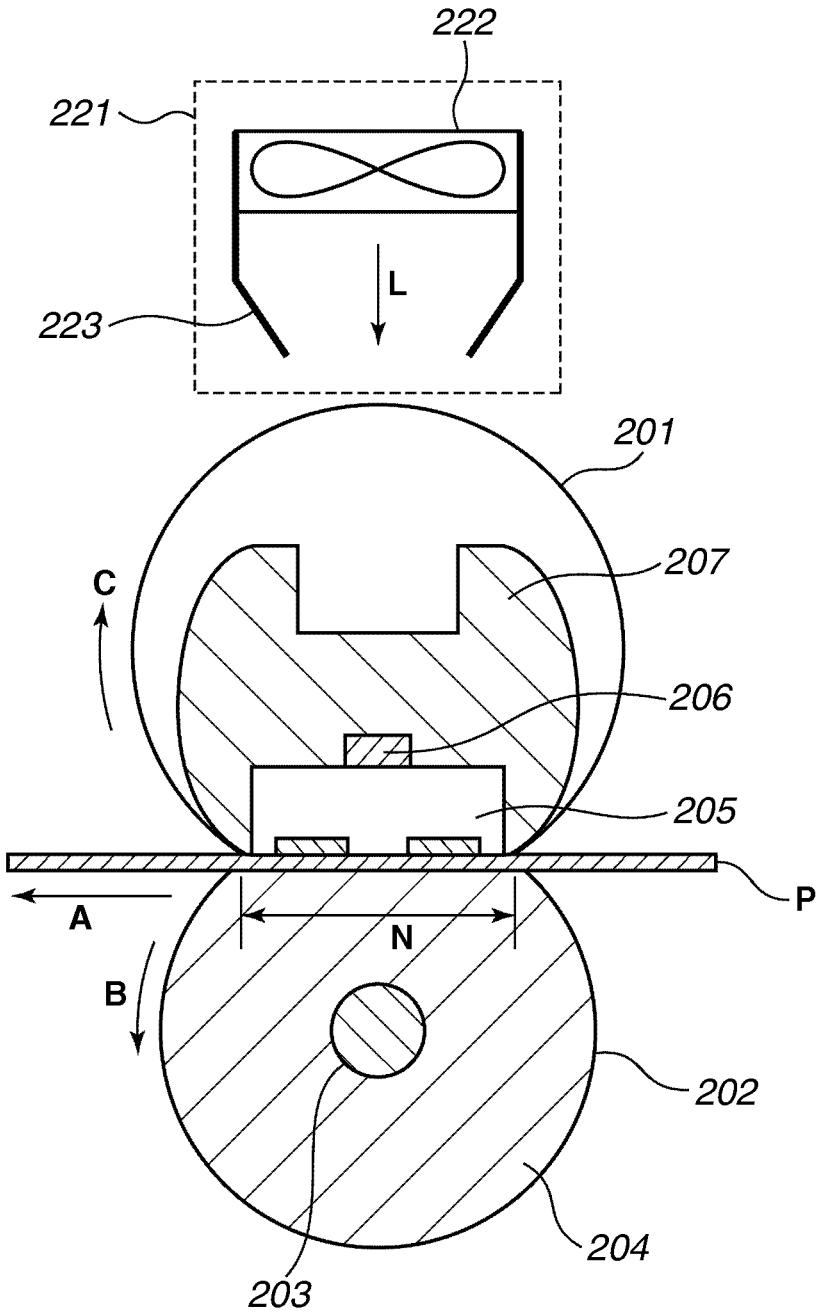
FIG. 3 is a cross-sectional view illustrating a configuration of the image fixing apparatus according to the first exemplary embodiment.

FIG. 3 illustrates a schematic configuration of the image fixing apparatus with a film heating method according to the present exemplary embodiment viewed from an arrow Z direction in FIG. 1. A ceramic heater 205 includes the heating portion 301, and a holder 207 holds the ceramic heater 205.

A heat-resistant film member 201 (hereinafter, referred to as a "fixing film") in a tubular shape is loosely fit into an outside of the holder 207 provided with the ceramic heater 205 serving as a heating source. The fixing film 201 has a thickness of approximately 40 to 100 μm, for example, and is made of materials described below.

More specifically, the fixing film 201 is a cylindrical single-layer film made of polytetrafluoroethylene (PTFE) and perfluoroalkoxy (PFA) having heat resistance, demolding property, strength, and durability, or a composite layer film coated on an outer peripheral surface of a tubular film made of polyimide or polyamide with PTFE, PFA, and fluorinated ethylene propylene (FEP). A pressing roller 202 is an elastic roller concentrically, integrally provided a heat-resistant elastic layer 204 made of silicon rubber in a roller-like shape with an outer periphery of a cored bar 203.

The pressing roller 202 is press-contacted with the ceramic heater 205 at a side of the holder 207 across the fixing film 201 therebetween against the elasticity of the pressing roller 202. An area indicated with an arrow N is a fixing nip portion formed by being press-contacted. The pressing roller 202 is rotationally driven by a driving motor (not illustrated) at a predetermined peripheral velocity in a direction of an arrow B. By the rotational drive of the pressing roller 202, the fixing film 201 is rotated in a direction of an arrow C. At the fixing nip portion N, the recording paper P carrying the unfixed toner image is conveyed to be nipped, so that the toner image is heated and fixed onto the recording paper P. An arrow A illustrated in FIG. 3 indicates a conveyance direction of the recording paper P.

Three thermistors 206 include thermistors Th1, Th2, and Th3 (illustrated in FIG. 4) described below, and are sequentially disposed in order of the thermistor Th2, the thermistor Th1, and the thermistor Th3 from a front of the diagram to a back thereof. The three thermistors 206 are press-contacted with the ceramic heater 205 with a predetermined pressure to detect the temperature of a surface of the ceramic heater 205. The thermistor Th1 detects the temperature of the fixing unit where a standard recording paper (a recording material) passes that has a smallest width and is available for the apparatus. The thermistor Th2 (a first temperature detection element) detects the temperature of one end region of the fixing unit where the standard recording paper (the recording material) does not pass that has the smallest width and is available for the apparatus. The thermistor Th3 (a second temperature detection element) detects the temperature of another end region of the fixing unit.

FIG. 3 illustrates an air supplying unit 221 including a cooling fan 222 (232) and a duct 223. The cooling fan 222 (a first fan) starts driving and cools the one end region when the detected temperature by the first temperature detection element reaches a cooling starting temperature. A cooling fan 232 (a second fan) starts driving and cools the other end region when the detected temperature by the second temperature detection element reaches a cooling starting temperature. An arrow L indicates a direction of supplying the air by the cooling fans 222 and 232. Cool air from the cooling fans 222 and 232 is supplied to the fixing film 201 via the duct 223.

(Ceramic Heater)

Figure 4:
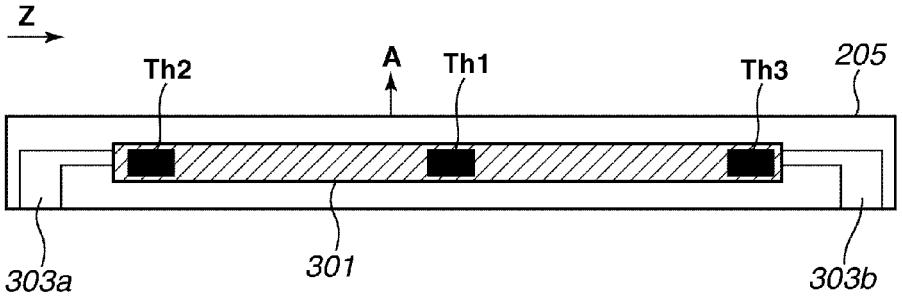
FIG. 4 illustrates a configuration of a ceramic heater.

FIG. 4 illustrates a configuration of the ceramic heater 205. The ceramic heater 205 is long in a direction orthogonal to a conveyance direction of the recording paper P. Alumina ($AL_2 0_3$) is used as a basic material, and a heating pattern (the heating portion) 301 is formed by performing printing on one side. Further, the heating pattern 301 is covered with a glass protection film serving as an electric insulation layer. Power supply electrodes 303*a* and 303*b* are formed such that a voltage can be applied to the both ends of the heating pattern 301.

(Temperature Detection Element)

As illustrated in FIG. 4, the image fixing apparatus according to the present exemplary embodiment includes three thermistors 206 as the temperature detection elements for measuring the temperature of the ceramic heater 205, and each thermistor is press-contacted with the ceramic heater 205 with a predetermined pressure. FIG. 4 illustrates the thermistors Th1, Th2, and Th3. The three thermistors Th1, Th2, and Th3 are disposed in the longitudinal direction of the ceramic heater 205. The thermistor Th1 is disposed at a center portion of the ceramic heater 205, and the thermistors Th2 and Th3 are disposed at each of the end portions thereof. Output of each of the thermistors Th1, Th2, and Th3 is input into the CPU 5 (illustrated in FIG. 2) of the image forming apparatus via a temperature detection circuit (not illustrated).

(Power Control Circuit)

Figure 5:
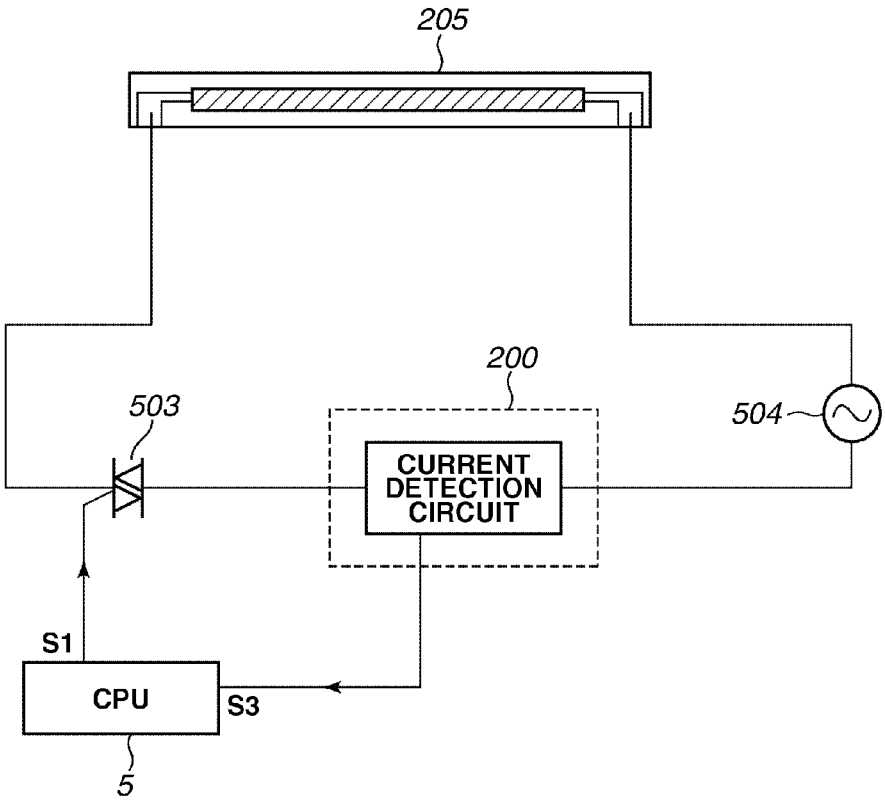
FIG. 5 illustrates a power control circuit of the heater.

A power control circuit for supplying power to the ceramic heater 205 will be described below. FIG. 5 illustrates connection of the power control circuit including the CPU 5, a triac 503, and an alternate current (AC) power source 504. The triac 503 and the ceramic heater 205 are connected in series, and the voltage is applied by the AC power source 504. The triac 503 is controlled to turn on and off by a heater driving signal S1 from the CPU 5. Based on the detected output of the above-described thermistor Th1 (illustrated in FIG. 4), the heater driving signal S1 is controlled to turn on and off to control the power to be supplied to the ceramic heater 205 so that the ceramic heater 205 can maintain the target temperature.

According to the present exemplary embodiment, the power is controlled so that the detected temperature by the thermistor Th1 (illustrated in FIG. 4) disposed at the paper-passing portion is maintained at 200° C. as a predetermined target temperature. The current detection circuit 200 detects a current flowing through the heater 205. The current detection circuit 200 adopts a method for sequentially detecting the current flowing through the image fixing apparatus.

A detection result (a signal S3) by the current detection circuit 200 is input into the CPU 5. Then, square arithmetic processing is performed on a detected current value by the CPU 5 and time averaging processing is further performed thereon to acquire a determined value of the current value. The averaging processing is performed every one second and sequentially updated. Since the power of the ceramic heater 205 is in proportion to the square of the applied current value, the signal S3 serving as the detection result by the current detection circuit 200 can detect the power value applied to the ceramic heater 205.

(Air Supplying Unit)

Figure 7:
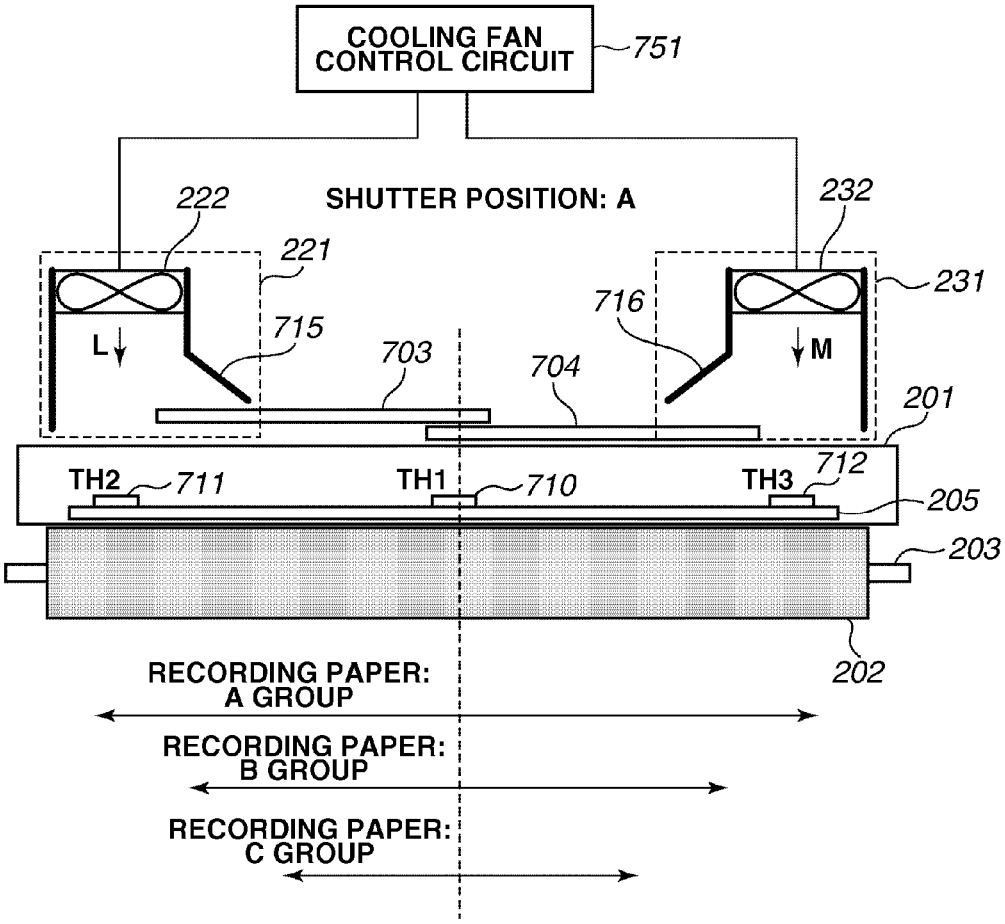
FIG. 7 illustrates the shutter positions when a paper size belongs to a B group.

With reference to FIG. 7, a configuration of the air supplying unit for cooing the fixing unit mounted on the image fixing apparatus will be described below. The air supplying unit (the cooling fans 222 and 232) for cooling the fixing unit is provided at the both end portions of the image fixing apparatus. The cooling fans 222 and 232 are driven by a cooling-fan control circuit 751, and, when the cooling fans 222 and 232 are driven, the cool air is supplied from the cooling fans 222 and 232. The cool air passing through the duct 223 (ducts 715 and 716) is supplied with the fixing film 201 in arrow directions L and M, and then cools the fixing film 201.

Figure 9:
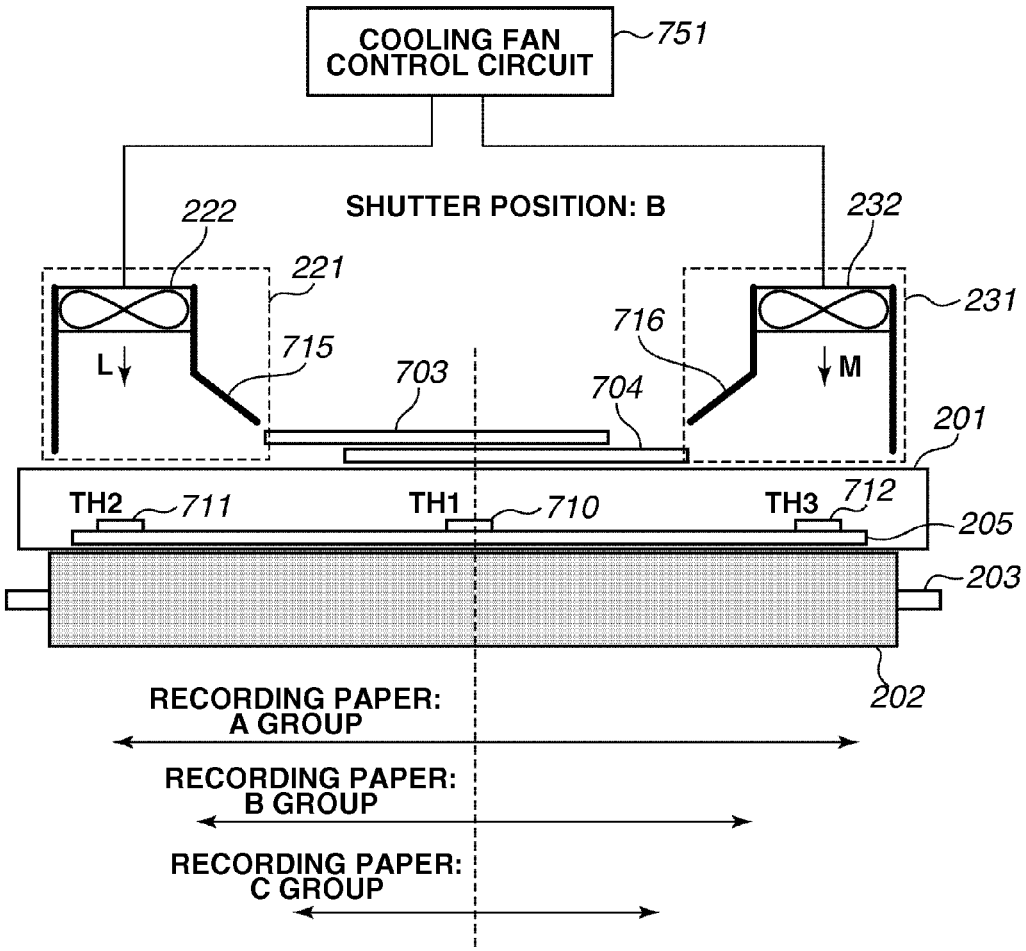
FIG. 9 illustrates the shutter positions when the paper size belongs to a C group.

Shutters 703 and 704 are displaced by a driving unit (not illustrated), which is used by the both shutters 703 and 704, to adjust an air path of the cool air supplied from the cooling fans 222 and 232. A first shutter 703 changes a width to be cooled by the first fan 222, and a second shutter 704 changes a width to be cooled by the second fan 232 in conjunction with the first shutter 703. Sutter positions are illustrated in two modes of a position A indicated in FIG. 7 and a position B illustrated in FIG. 9, and the air paths of the cool air are switched for each mode. Initial shutter positions are provided in a state where the air path is completely shut (closed) (illustrated in FIG. 10). The shutter positions are determined based on a shutter position setting table illustrated in FIG. 6. When the recording paper P belongs to a B group illustrated in FIG. 6, the shutters 703 and 704 are set at the position A (illustrated in FIG. 7). When the recording paper P belongs to a C group, the shutters 703 and 704 are set at the position B (illustrated in FIG. 9).

Figure 10:
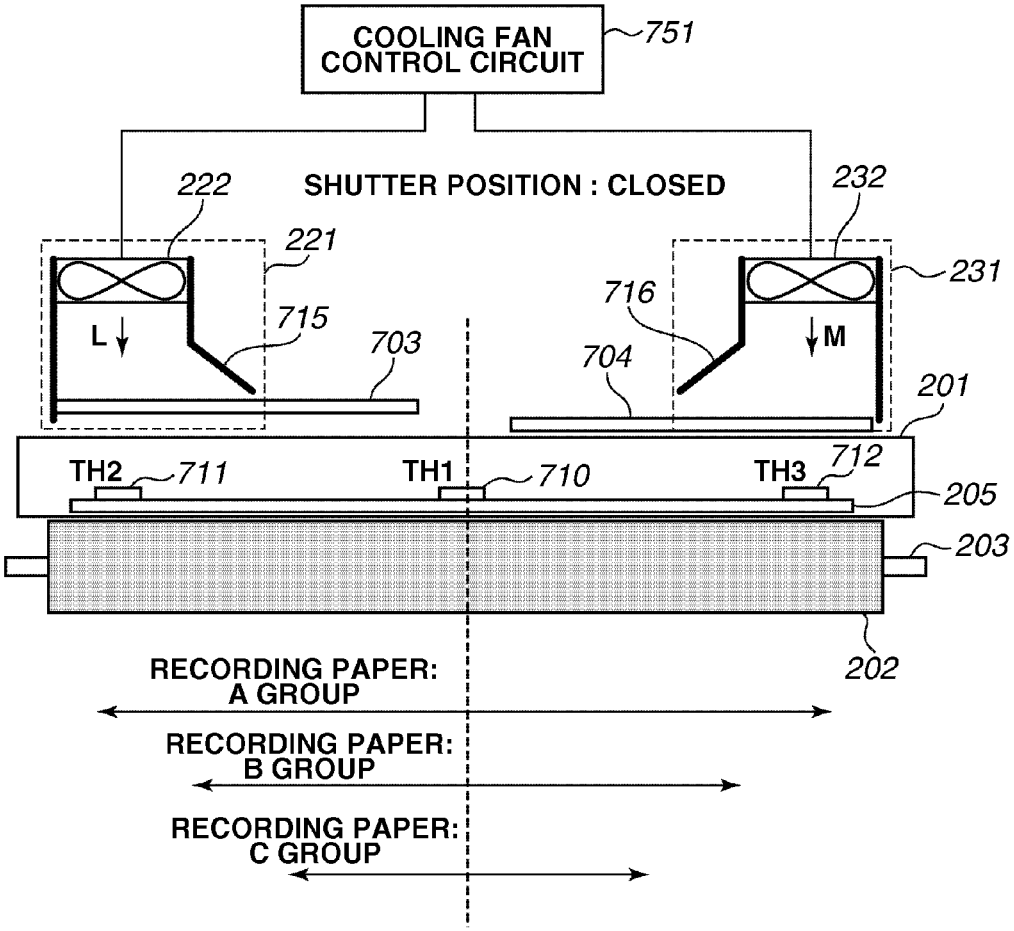
FIG. 10 illustrates the shutter position when the paper size belongs to an A group.

As described above, according to the size of the recording paper P, the length in a width direction (the width to be cooled) of the air opening is adjusted to adjust a cooling effect at the both end portions. Thus, the temperature of the non-paper-passing portion may be prevented from rising even when the paper in different sizes is used. When the recording paper P belonging to the A group passes, as illustrated in FIG. 10, the shutters 703 and 704 are set to be shut (closed). Since the width of the recording paper P belonging to the A group is substantially equal to the width of the heating member of the ceramic heater 205, the temperature of non-paper-passing portion does not rise. Thus, the cooling fans 222 and 232 stop during printing, and the shutters 703 and 704 are closed.

(Fan Control Circuit)

Figure 8:
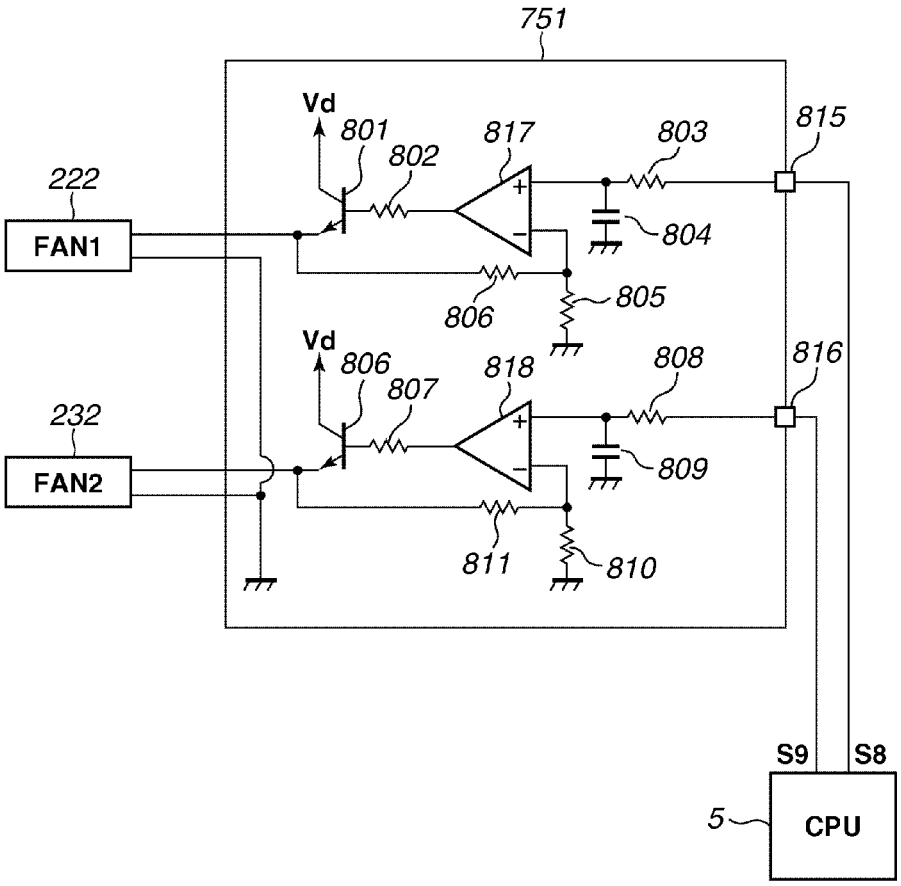
FIG. 8 illustrates a cooling fan driving circuit.

FIG. 8 illustrates the cooling-fan control circuit 751 (illustrated in FIG. 7) included in the fan control unit 400 (illustrated in FIG. 1). The cooling-fan control circuit 751 drives two fans of the cooling fans 222 and 232, which are respectively controlled by the signals S8 and S9 output from the CPU 5. The signals S8 and S9 output from the CPU 5 are pulse-width modulated signals. The signal S8 input via a terminal 815 is converted into a direct voltage by a filter including a resistance 803 and a capacitor 804 and input into a plus input terminal of an operational amplifier 817.

When the voltage is generated at an output terminal of the operational amplifier 817, the current is applied to a base of a transistor 801 via a resistance 802 to turn on the transistor 801. Then, the voltage is applied to the cooling fan 222. On the other hand, an emitter of the transistor 801 is connected to a minus input terminal of the operational amplifier 817 via resistances 805 and 806. The voltage to be applied to the cooling fan 222 is divided by the resistances 805 and 806, and then fed back to the operational amplifier 817. By such a circuit, a voltage corresponding to the voltage level of the signal S8 is applied to the cooling fan 222. Driving voltage V222 for driving the cooling fan 222 can be expressed by an equation described below.

$$V222=(R805+R806)/R805\times Vd\times \mathrm{DUTY}(S8) \quad (1)$$

Further, likewise, the driving voltage V232 for driving the cooling fan 232 can be expressed by an equation described below.

$$V232=(R810+R811)/R810\times Vd\times \mathrm{DUTY}(S9) \quad (2)$$

wherein R805, R806, R810, and R811 respectively indicate resistance values of resistance 805, resistance 806, resistance 810, and resistance 811. Furthermore, signals S8 and S9 each generate an amplitude voltage Vd. With the driving voltage value expressed by the above-described equations, the rotation speed of each cooling fan is determined.

(Fan Control Method)

A control method of the cooling fans 222 and 232 according to the present exemplary embodiment will be described below. According to the present exemplary embodiment, a case is described where extremely large difference is generated between the detected temperatures of the thermistors Th2 and Th3 disposed at the end portions, in other words, a case is described where the recording paper P is passed as leaning against a side of the end portion D (illustrated in FIG. 1B) in a conveyance direction A (illustrated in FIG. 1B) In such a case, the temperature of the end portion C at a side where the first temperature detection element TH2 is disposed is high. In other words, the temperature of the other end portion D at a side where the second detection element TH3 is disposed is lower than that of the end portion C.

At this point, when the temperature detected by the thermistor Th2, which is the temperature detection element disposed at the end portion C (illustrated in FIG. 1B), is a cooling fan driving temperature (a cooling starting temperature) Tfd or higher, the driving voltage of the cooling fan 222 for cooling the end portion C (illustrated in FIG. 1B) is set to the first driving voltage (corresponding to the first rotation speed). Further, when the temperature detected by the thermistor 2 disposed at the end portion C (illustrated in FIG. 1B) is the cooling fan driving temperature Tfd or higher, and also the temperature detected by the thermistor Th3 disposed at the end portion D (illustrated in FIG. 1B) is the cooling fan driving temperature Tfd or lower, the driving voltage lower than the first driving voltage for driving the cooling fan 232 cooling the end portion D (illustrated in FIG. 1B) is set to a second driving voltage (corresponding to the second rotation speed). The cooling fan driving temperature Tfd is set to a temperature sufficiently lower than the temperature, at which the end portion of the ceramic heater 205 is damaged due to the rise of the temperature of the non-paper-passing portion.

Figure 11:
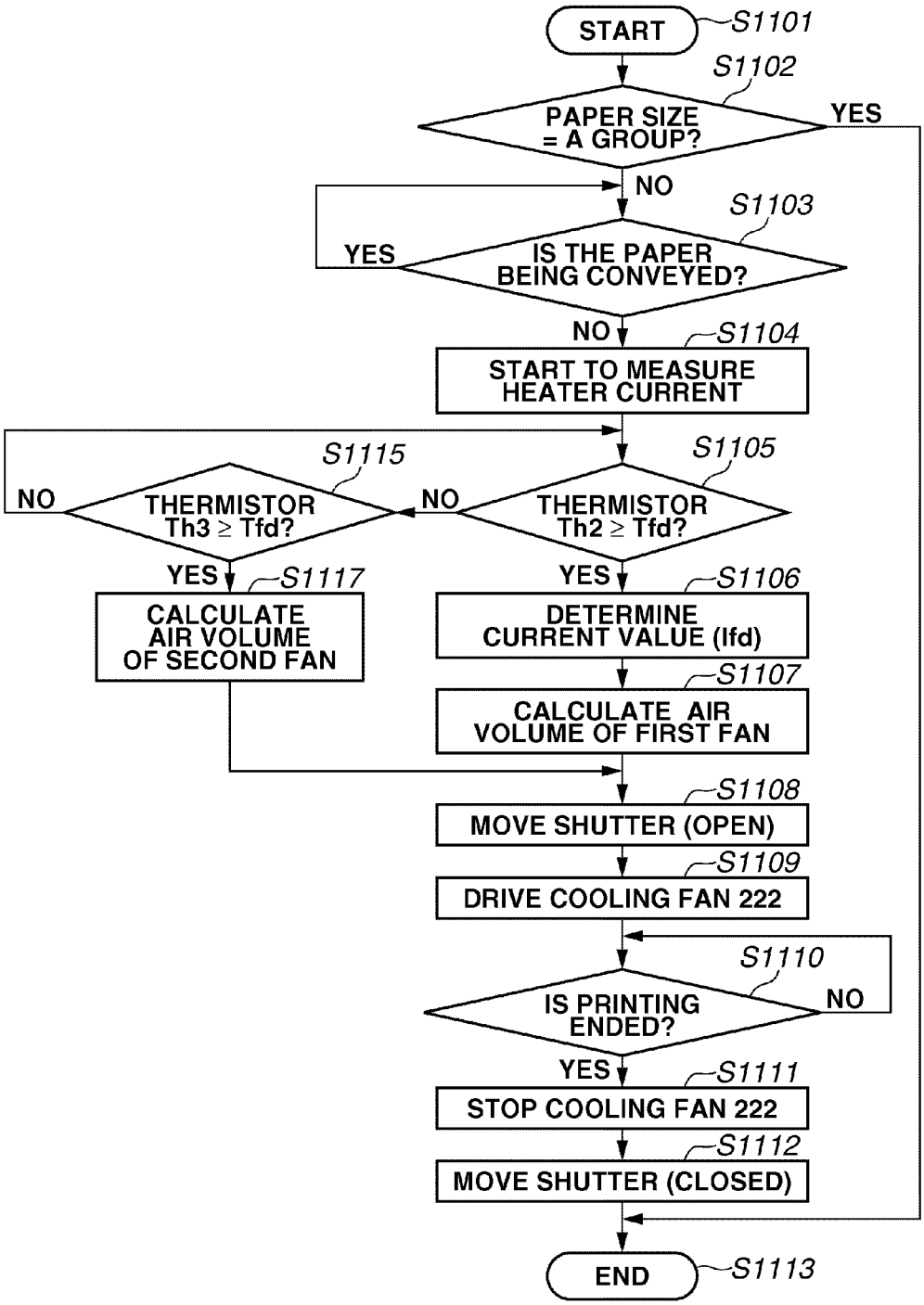
FIG. 11 is a flowchart illustrating controlling airflow of an air supplying unit at an end portion C according to the first exemplary embodiment.
Figure 12:
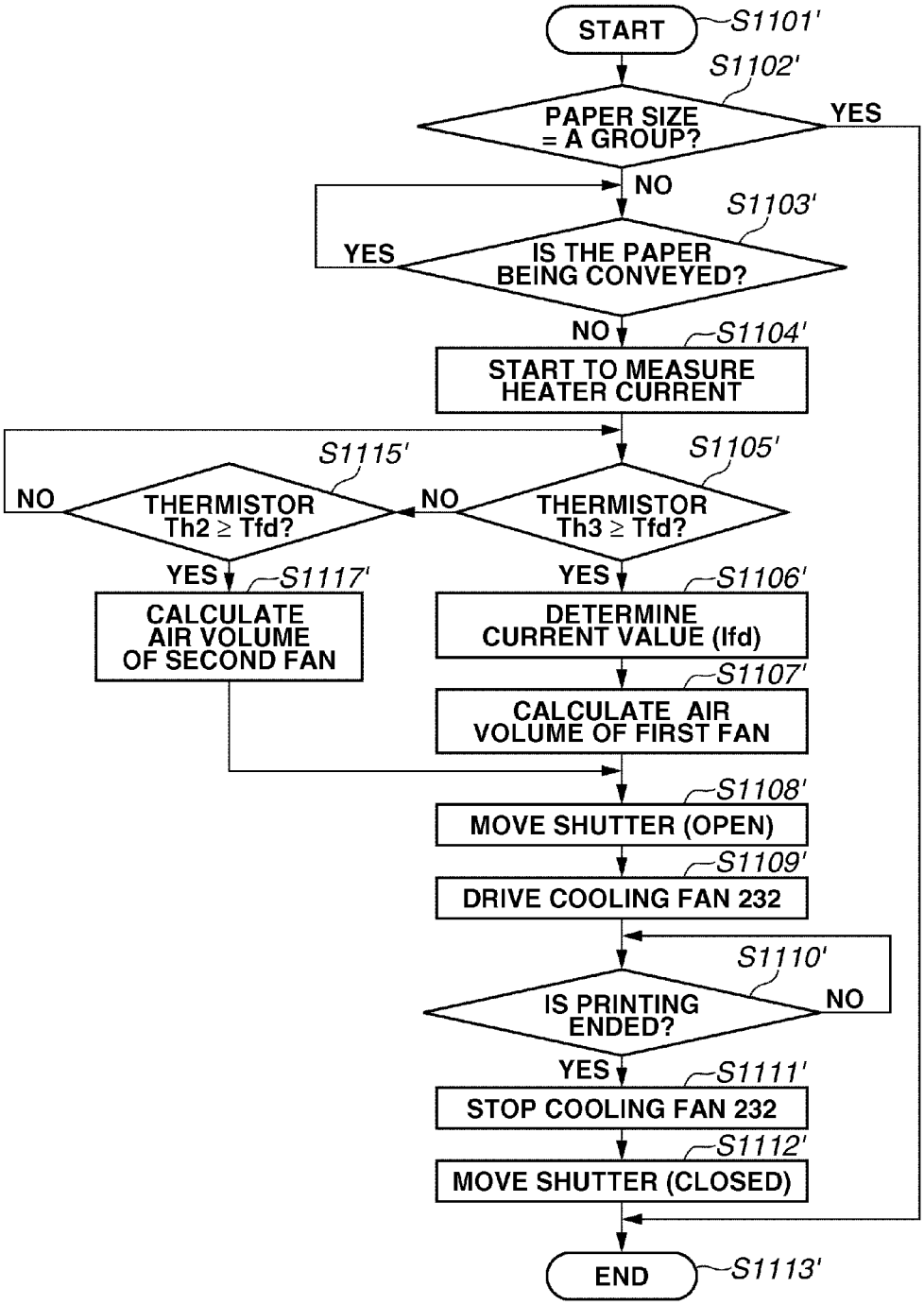
FIG. 12 is a flowchart illustrating controlling airflow of an air supplying unit at an end portion D according to the first exemplary embodiment.
Figure 13:
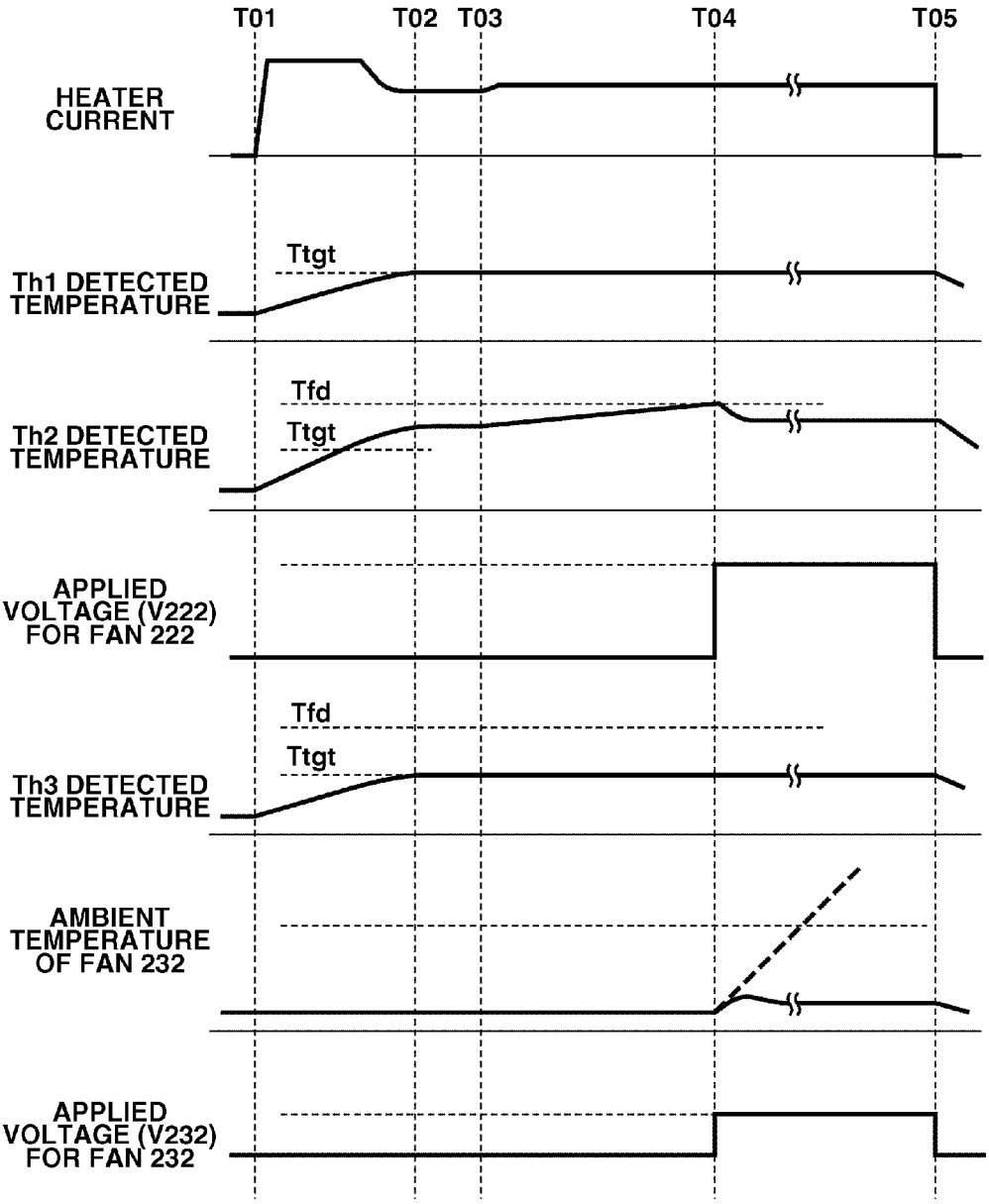
FIG. 13 is a timing chart according to the first exemplary embodiment.

FIG. 13 illustrates timing among a heater current, each thermistor temperature, an ambient temperature of the cooling fan 232 cooling the end portion D (illustrated in FIG. 1B), and driving of the cooling fans 222 and 232 when printing is sequentially performed. FIG. 11 is a flowchart illustrating a method of a series of control of the cooling fan 222 at the end portion C (illustrated in FIG. 1B). FIG. 12 is a flowchart illustrating a method of a series of control for the cooling fan 232 at the end portion D (FIG. 1B).

In FIG. 13, when printing is started at timing T01, the image fixing apparatus 116 is driven and the power is supplied to the ceramic heater 205 by driving of the power control circuit described above.

With this operation, there are rise in the temperatures of the thermistor Th1, which is the temperature detection element of the paper passing portion disposed at a center portion of the ceramic heater 205, and the thermistors Th2 and Th3, which are the temperature detection elements of the non-paper-passing portions disposed at the end portions thereof. According to the present exemplary embodiment, the thermistors Th2 and Th3, which are the temperature detection elements of the non-paper-passing portions, are disposed at positions that are the non-paper-passing portions where the recording material having the smallest width for passing does not pass and that are commonly used for each recording material having different widths.

The power to be supplied to the ceramic heater 205 is controlled by the power control circuit so that the temperature of the thermistor Th1, which is the temperature detection element of the paper passing portion disposed at a center portion of the ceramic heater 205, becomes a predetermined target temperature Ttgt. When the temperature of the thermistor Th1, which is the temperature detection element of the paper passing portion, continues to rise, so that the temperature of the thermistor Th1 reaches the target temperature Ttgt, the recording paper P is fed from the deck 101 (Timing T02).

When the recording paper P arrives at the image fixing apparatus 116 (Timing T03) after the above-described electrophotographic process processing procedure, fixing processing is performed on the recording paper P. After the recording paper P passes through the image fixing apparatus 116, temperature of the thermistor Th1, which is the temperature detection element of the paper passing portion, transitions around the target temperature Ttgt.

The thermistor Th3, which is the temperature detection element of the non-paper passing portion, is disposed at a side where there is no non-paper-passing portion due to the recording paper P leaning against the end portion even in spite of the small recording paper P being used for printing, or at a side where the non-paper-passing portion is narrower than that in a case where the recording paper is conveyed according to a conveyance reference. Thus, as described above, the heat is removed from the recording paper P and the temperature transitions around the target temperature Ttgt or the similar temperature thereto.

The thermistor Th2, which is the temperature detection element of the non-paper passing portion, continues to rise over the target temperature Ttgt due to the above-described phenomenon of the rise of the temperature of the non-paper-passing portion. When the thermistor Th2, which is the temperature detection element of the non-paper passing portion, reaches the predetermined cooling fan driving temperature (the cooling starting temperature) Tfd, the cooling fan 222 (illustrated in FIG. 1B) and the shutters 703 and 704 for adjusting the air path of the cool air are started to be driven (timing T04). When the cooling fan 222 starts to be driven, the detected temperature by the thermistor Th3 has not reached the cooling fan driving temperature Tfd. However, the cooling fan 232 (illustrated in FIG. 1B) starts to be driven with the second driving voltage (the second rotation speed) lower than the first driving voltage (the first rotation speed) not to reduce the rise of the temperature of the non-paper-passing portion in the fixing unit but to protect components included in the cooling fan 232 from the rise of the temperature the component thereof. With this operation, the heat is not easily transmitted from the fixing unit to the cooling fan 232 via the opening portion of the shutter.

As described above, according to the present exemplary embodiment, when the temperatures are different between the one end region and the other end region during the fixing processing, one fan corresponding to the end portion having the higher temperature is driven at the first rotation speed when the detected temperature by the temperature detection element corresponding to the fan reaches the cooling starting temperature. When the one fan is driven at the first rotation speed and when the detected temperature by the temperature detection element corresponding to another fan belongs to a temperature region lower than the cooling starting temperature, the other fan is driven at the second rotation speed lower than the first rotation speed.

After the cooling fan 222 (illustrated in FIG. 1B) starts to cool the end portion of the ceramic heater 205, the detected temperature by the thermistor Th2, which is the temperature detection element of the non-paper-passing portion, is lowered. When a predetermined recording operation is completed (timing T05), the power supply to the heater is stopped and an operation of each cooling fan is also stopped.

With reference to FIGS. 11 and 12, a control procedure of the cooling fan performed by the CPU 5 (illustrated in FIG. 2) will be described below. FIG. 11 is a flowchart illustrating controlling the cooling fan 222 disposed at a side of the end portion C according to the present exemplary embodiment. FIG. 12 is a flowchart illustrating controlling the cooling fan 232 disposed at a side of the end portion D.

At timing 101 (illustrated in FIG. 13), as illustrated in FIG. 11, in step S1102, the recording paper P, on which printing is to be performed, is classified into an A group, a B group, and a C group illustrated in FIG. 10. The CPU 5 (illustrated in FIG. 2) determines whether the recording paper P belongs to the A group. When the recording paper P belongs to the A group (YES in step S1102), the processing proceeds to step S1113. In step S1113, the CPU 5 (illustrated in FIG. 2) performs printing processing without driving the cooling fan 222. When the recording paper P belongs to the A group, as described above, since the recording paper P has the size substantially equal to a width of the heating portion 301 of heating of the ceramic heater 205 and the temperature of the non-paper-passing portion rises a little, the CPU 5 (illustrated in FIG. 2) does not cool the fixing device by the cooling fans 222 and 232. On the other hand, when the recording paper P belongs to the B group or the C group (NO in step S1102), the CPU 5 (illustrated in FIG. 2) performs cooling operation in a series of processing subsequent step S1103 using the cooling fans 222 and 232.

When the temperature by the thermistor Th1, which is the temperature detection element of the paper passing portion, reaches the target temperature Ttgt at timing T02 (illustrated in FIG. 13), then in step S1103, the CPU 5 (illustrated in FIG. 2) confirms a state of the recording paper P passing through the image fixing apparatus 116. When the recording paper P has passed through the image fixing apparatus 116, the processing proceeds to step S1104. In step S1104, the current detection circuit 200 (illustrated in FIG. 5) described above starts to measure the heater current.

In step S1105, the temperature by the thermistor Th2, which is the temperature detection element of the non-paper-passing portion, is monitored. When the temperature reaches the cooling fan operation temperature Tfd, which is the second temperature, (YES in step S1105), the CPU 5 (illustrated in FIG. 2) performs processing from step S1106 to step S1109. In other words, the CPU 5 (illustrated in FIG. 2) determines the current value, calculates an air volume of the cooling fan 222, moves the shutters, and drives the cooling fan 222. In step S1106, the measurement of the heater current started by the current detection circuit 200 in step S1104 is stopped, and a determined control value (a current value) Ifd is acquired.

As described above, the power supply to the heater 205 is controlled so that the heater 205 can maintain the target temperature Ttgt. On the other hand, the control value (the current value) Ifd, when the thermistor Th2, which is the temperature detection element of the non-paper-passing portion, reaches the predetermined cooling starting temperature Tfd, is determined for controlling the air volume. As described above, since an average value of a movement is measured at every one second as the heater current value, the control value (the current value) Ifd is the average value of a section one second earlier than the timing T04 (the control value (the current value) Ifd may be also the current value at the timing T04).

Subsequently, in step S1107, processing for determining the air volume of the cooling fan 222 is performed. The air volume of the cooling fan 222 is set according to the control value (the current value) Ifd and a size of the passing recording paper P. More specifically, the air volume is determined using a cooling fan driving voltage setting table illustrated in FIG. 14. The recording paper P is classified into a I group to a IV group according to the size of the recording paper in a main scanning direction. Further, the heater current value is classified into four types. The cooling fan driving voltage is determined depending on combination of the heater current and the size of the recording paper. For example, when the recording paper P is LTR long edge feed and the heater current value is 8 A, since the size of the recording paper is classified into the II group and the heater current value is classified into a group of 7 A≤Ifd<9 A, the cooling fan driving voltage is determined to be 10V.

As illustrated in FIG. 14, the greater the heater current value Ifd is, the higher the cooling fan driving voltage is set. In other words, depending on an amount of the power supply for heating the fixing film 201, which is a heating-rotatable member, the air volume is controlled so that the greater the amount of the power supply is, the greater the air volume is supplied. That is because the greater the heater current value is, the higher the temperature of the non-paper-passing portion region rises. Thus, to reduce the rise of the temperature of the non-paper-passing portion, the cooling fans 222 and 232 need to strongly cool down the non-paper-passing portion.

Further, the reason why the cooling fan driving voltage is set different depending on the size of the recording paper P is that the current required for controlling the temperature varies depending on a length of the paper in the main scanning direction. By setting the cooling fan driving voltage with the method described above, appropriate cooling performance of the cooling fan for reducing the rise of the temperature of the non-paper-passing portion can be set. The first rotation speed for cooling the non-paper-passing portion of the fixing unit may be set according to at least one of the size of the recording material P and the current flowing through the heater 205 of the fixing unit.

In step S1108 illustrated in FIG. 11, the CPU 5 (illustrated in FIG. 2) moves the shutters 703 and 704 to a predetermined position according to the table in FIG. 6. Then in step S1109, the CPU 5 (illustrated in FIG. 2) starts to drive the cooling fan 222 (at the timing T04) with the cooling fan driving voltage determined in step S1107 as described above.

When the CPU 5 (illustrated in FIG. 2) determines that printing has been completed in step S1110 (YES in S1110), then in step S1111, the CPU 5 stops the cooling fan 222. In step S1112, the CPU 5 closes the shutters 703 and 704, and then, the series of processing ends.

As illustrated in FIG. 12, steps from step S1101' to step S1113', step S1115', and step S1117' are respectively equivalent to steps from step S1101 to step S1113, S1115, and S1117 illustrated in FIG. 11. Timing of each item has the corresponding, and same number. A difference of control between the cooling fan 222 and the cooling fan 232 according to the present exemplary embodiment is that, in S1105', the detected temperature by the thermistor Th3, which is the temperature detection element of the non-paper-passing portion, does not reach the cooling operation temperature Tfd. In addition, in step S1115' which is the subsequent processing, the detected temperature of the thermistor Th2, which is the temperature detection element of the other non-paper-passing portion, reaches the cooling fan operation temperature Tfd, which is the second temperature.

When the processing of step S1105' and step S1115' is performed, when the temperature by the thermistor Th3, which is the temperature detection element of the non-paper-passing portion, has not reached the cooling fan operation temperature Tdf (NO in step S1105'), and the thermistor Th2, which is the temperature detection element of the other non-paper-passing portion, has reached the cooling fan operation temperature Tfd, which is the second temperature, (YES in step S1115'), then in step S1117', the second driving voltage is set. Then, the processing proceeds to step S1108'. The second cooling fan driving voltage is determined according to the shutter position determined in FIG. 6.

As illustrated in FIG. 14, the greater the amounts of the movements of the shutters 703 and 704 are, the higher the second driving voltage is set. In other words, the second rotation speed is set according to the amounts of the movements of the shutters. That is because, since an area where warm air around the fixing device impacts the cooling fan 232 is spread, to protect the cooling fan 232 from the rising warm air, the air volume of the cooling fan 232 needs to be increased.

Figure 15:
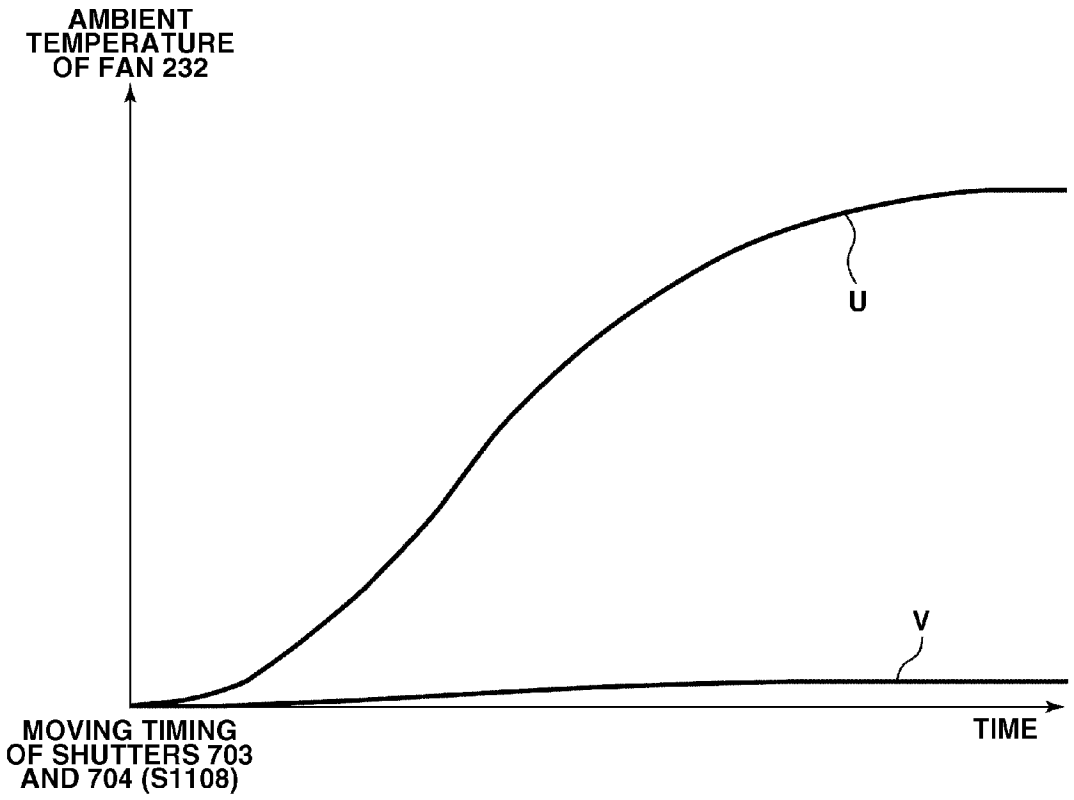
FIG. 15 illustrates cooling fan driving timing according to the first exemplary embodiment.

As described above, in step S1117' illustrated in FIG. 12, the second driving voltage of the cooling fan 232 is set according to FIG. 6. Then in step S1108', the CPU 5 moves the shutters 703 and 704 thereby to start to drive the cooling fan 232 in step S 1109' (timing T04). FIG. 15 illustrates a relationship between the time when the shutters 703 and 704 start to move to the shutter position A and the ambient temperature of the cooling fan 232. A line U indicates the ambient temperature of the cooling fan 232 when the cooling fan 232 does not perform cooling. A line V indicates the ambient temperature of the cooling fan 232 when the cooling fan 232 is driven with the second driving voltage. By performing the control according to the present exemplary embodiment, the rise of the ambient temperature of the cooling fan 232 can be reduced.

In step S1110', when the CPU 5 determines that printing has ended (YES in step S1110'), then in step S1111', the CPU 5 stops the cooling fan 232. In step S1112', the CPU 5 closes the shutters 703 and 704, and then, the series of processing ends.

According to the present exemplary embodiment, when the detected temperature by the thermistor Th2, which is the temperature detection element of the non-paper-passing portion at the side where the temperature is high, reaches the cooling fan driving temperature Tfd, the CPU 5 starts to drive the cooling fan 222 for supplying the air for the cooling and the shutters 703 and 704 for adjusting the air path of the cool air. When the CPU 5 starts to drive the cooling fan 222, the detected temperature by the thermistor Th3, which is the temperature detection element of the non-paper-passing portion at the side where the temperature is low, has not reached the cooling fan driving temperature Tfd, the CPU 5 drives the cooling fan 232 with the second driving voltage. With this operation, for any type and size of the recording paper P to be passed, the end portions may be appropriately cooled by the cooling fans. Further, the components included in the cooling fans may be prevented from being deteriorated and damaged due to the rise of the temperature.

As described above, in the image fixing apparatus according to the present exemplary embodiment, when the detected temperature by the thermistor Th2, which is the temperature detection element of the non-paper-passing portion, is the cooling starting temperature by the cooling fan 222 or higher, and the detected temperature by the thermistor Th3, which is the temperature detection element of the non-paper-passing portion, is the cooling starting temperature or lower, the cooling fan 232 is driven using the second driving voltage. By performing such control, the cooling fan 232 may be prevented from being damaged and significantly deteriorated in the characteristics thereof due to the rise of the temperature of the components included in the cooling fan 232 at the side where the detected temperature by the thermistor Th3, which is the temperature detection element of the non-paper-passing portion, is the cooling starting temperature or lower.

A second exemplary embodiment will be described below. A basic configuration of the image fixing apparatus according to the present exemplary embodiment is the same as that according to the first exemplary embodiment. Similar to the first exemplary embodiment, when it is determined that the control with the second driving voltage is required, the image fixing apparatus according to the present exemplary embodiment refers to the detected temperature by the thermistor in addition to the amounts of the movements of the shutters for a factor in determining the second driving voltage. Only the point different from the first exemplary embodiment will be described below.

Figure 16:
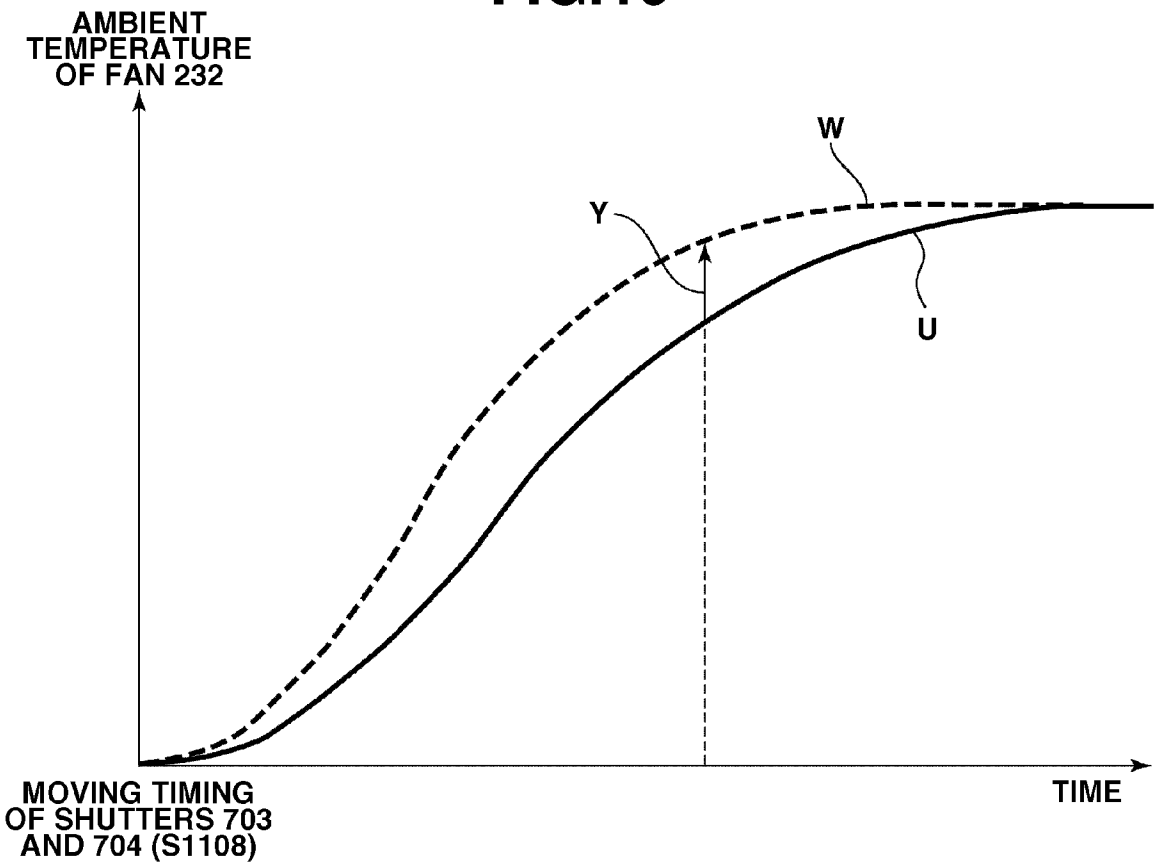
FIG. 16 illustrates correction of cooling fan driving voltage based on a detected temperature by a thermistor Th3 according to a second exemplary embodiment.

FIG. 16 illustrates correction in relationship between the time when the shutters 703 and 704 start to move to the shutter position A, and the rise of the ambient temperature of the cooling fan 232 based on the detected temperature by the thermistor Th3, which is the temperature detection element of the non-paper-passing portion. The line U, which is also illustrated in FIG. 15, indicates the rise of the ambient temperature of the cooling fan 232 according to the first exemplary embodiment. A broken line W indicates the correction in a ratio of the rise of the ambient temperature of the cooling fan 232 to the line U based on the detected temperature by the thermistor Th3, which is the temperature detection element of the non-paper-passing portion An arrow Y indicates an amount of the correction. When the detected temperature by the thermistor Th3, which is the temperature detection element of the non-paper-passing portion, is higher than the detected temperature by the thermistor Th1, which is the temperature detection element of the paper-passing portion disposed at a center of the heater, a great amount of heat is generated at the end portion. Thus, the ratio of the rise of the ambient temperature of the cooling fan 232 is increased accordingly. The amount of the rise of the ambient temperature is corrected, and the second driving voltage for driving the cooling fan 232 is corrected to be set high, so that efficiency of cooling by the cooling fan 232 may be set to an accurate and appropriate value.

With this operation, even if difference is generated in the temperatures of the both end portions of the ceramic heater 205, when the detected temperature by the thermistor Th3, which is the temperature detection element of the non-paper-passing portion, is the cooling starting temperature or lower, the cooling fan 232 can be prevented from being damaged and significantly deteriorated in the characteristics due to the rise of the temperature of the components included in the cooling fan 232.

A third exemplary embodiment will be described below. A basic configuration of the image fixing apparatus according to the present exemplary embodiment is similar to that according to the first and second exemplary embodiments. Similar to the first and second exemplary embodiments, in the image fixing apparatus according to the present exemplary embodiment, when it is determined that the control with the second driving voltage is required, and after the driving voltage is set, timing for driving the cooling fan with the second driving voltage is set. Only the points different from the first and second exemplary embodiments will be described below.

Figure 17:
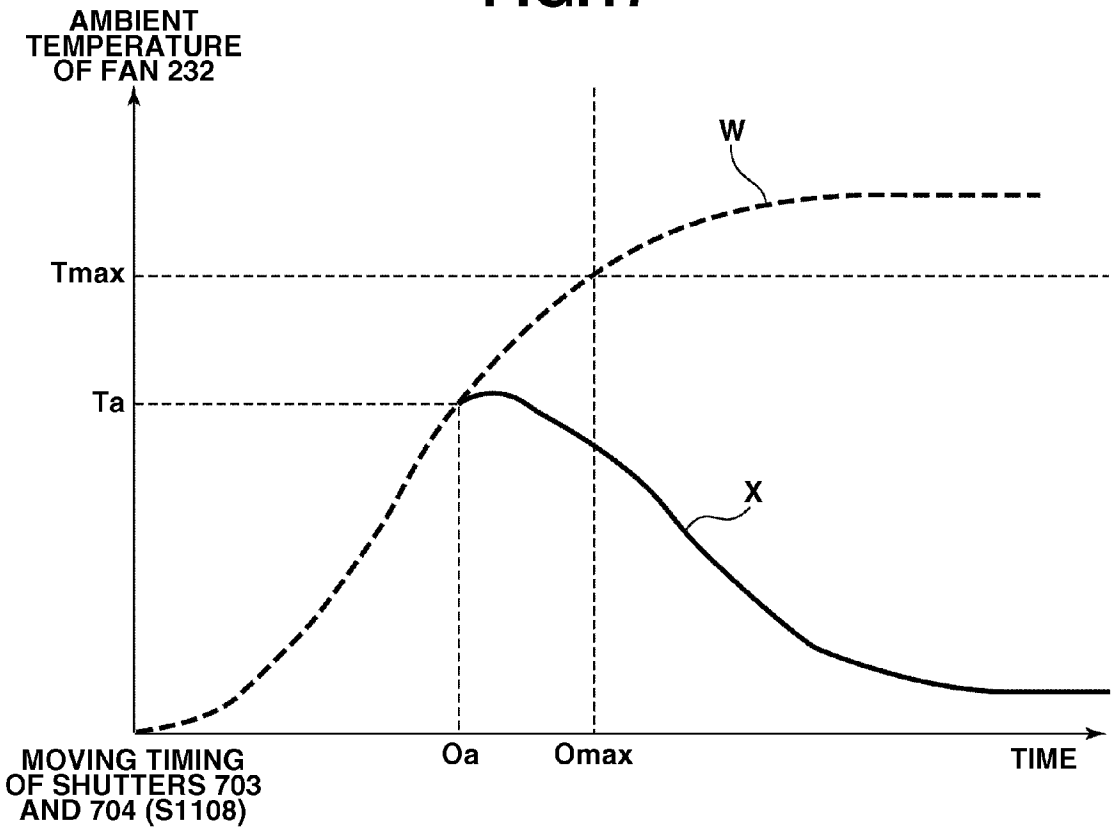
FIG. 17 illustrates cooling fan driving timing according to a third exemplary embodiment.

FIG. 17 illustrates a temperature Tmax that is a limit temperature for satisfying the characteristics of the components of the cooling fan 232 and a reaching time Omax of the temperature Tmax in addition to the diagram only indicating the broken line W in the diagram in FIG. 16 illustrating the correction of the relationship between a time when the shutters 703 and 704 start to move to the shutter position A and the rise of the ambient temperature of the cooling fan 232 based on the detected temperature by the thermistor Th3, which is the temperature detection element of the non-paper-passing portion. As illustrated in FIG. 17, the ambient temperature of the cooling fan 232 does not instantly rise, but gradually reaches the limit temperature Tmax, at which the characteristics of the components of the cooling fan 232 can be satisfied. Therefore, after the shutters 703 and 704 are moved, at a time Oa when the temperature Ta is detected that is lower than the limit temperature Tmax, which satisfies the component of the cooling fan 232, of the detected temperature by the thermistor Th3, which is the non-paper-passing temperature detection element, the cooling fan 232 is driven with the second driving voltage. With this operation, the ambient temperature of the cooling fan 232 is indicated by a line X illustrated in FIG. 17.

Figure 18:
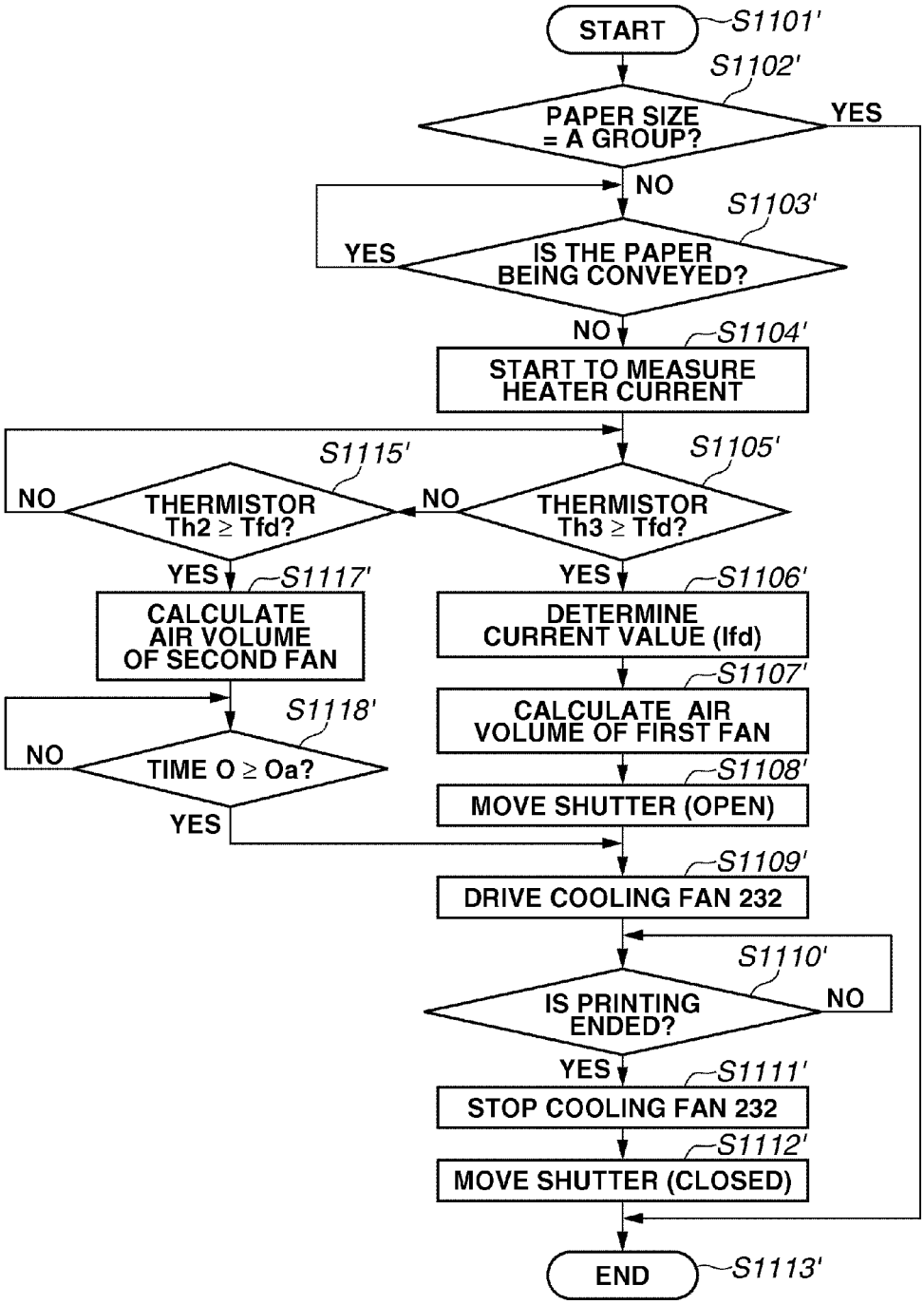
FIG. 18 is a timing chart according to the third exemplary embodiment.

FIG. 18 is a flowchart illustrating control of the cooling fan 232 according to the present exemplary embodiment. Until the second driving voltage is set, the same procedure as that of the second exemplary embodiment described above is performed. Subsequently, in step S1118', an elapsed time since the shutters 703 and 704 have been started to move is monitored. When the elapsed time reaches the time Oa when the temperature Ta is detected that is lower than the limit temperature Tmax, which satisfies the component of the cooling fan 232, of the detected temperature by the thermistor Th3, which is the non-paper-passing temperature detection element, (YES in step S1118'), the processing in step S1109' is started to drive the cooling fan 232.

With the operations described above, the number of activations of the cooling fan 232 can be reduced, or the driving time can be reduced. Thus, in addition to the effects of the first and second exemplary embodiments, another effect of the cooling fan 232 being used for longer hours can be acquired.

The temperature Ta lower than the limit temperature Tmax for satisfying the characteristics of the components of the cooling fan 232 according to the present exemplary embodiment is set by 10 degrees lower than the limit temperature Tmax for satisfying the characteristics for the component of the cooling fan 232. However, the value may be arbitrary set.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-053583 filed Mar. 9, 2012, which is hereby incorporated by reference herein in its entirety.

What is claimed is:

1. An image fixing apparatus comprising:

a fixing unit configured to heat and fix, onto a recording material, an unfixed image formed on the recording material;

a first temperature detection element configured to detect a temperature of one end region in the fixing unit where a standard recording material does not pass that has a smallest width and is available for the apparatus;

a second temperature detection element configured to detect a temperature of another end region in the fixing unit;

a first fan configured to cool the one end region by starting to be driven when the temperature detected by the first temperature detection element reaches a cooling starting temperature;

a second fan configured to cool the other end region by starting to be driven when the temperature detected by the second temperature detection element reaches a cooling starting temperature;

a first shutter configured to change a width to be cooled by the first fan; and a second shutter configured to change a width to be cooled by the second fan, the second shutter moves in conjunction with the first shutter, wherein the apparatus is configured to drive the first and second shutters according to a size of the recording material to change the widths to be cooled by the first and second fans; and wherein, if the temperature of the one end region is different from that of the another end region during fixing processing, when the temperature detected by the temperature detection element corresponding to one of the first and second fans corresponding to one end region where the temperature is higher reaches the cooling starting temperature, the one fan starts to be driven at a first rotation speed, and, when the temperature detected by the temperature detection element corresponding to another fan within a temperature range lower than the cooling starting temperature while the one fan is being driven at the first rotation speed, the other fan starts to be driven at a second rotation speed lower than the first rotation speed.

2. The image fixing apparatus according to claim 1, wherein the first rotation speed is set according to at least one of a size of the recording material and a current flowing through a heater in the fixing unit.

3. The image fixing apparatus according to claim 1, wherein the second rotation speed is set according to movement amounts of the shutters.

4. The image fixing apparatus according to claim 1, wherein the first and second shutters starts moving so as to open an air flowing opening when at least one of the first and second temperature detection elements detects the cooling starting temperature.

5. The image fixing apparatus according to claim 1, wherein the fixing unit includes a cylindrical film and a heater in contact with an inner surface of the film, and wherein the first and second temperature detection elements detects a temperature of the heater.

6. An image fixing apparatus comprising:

a fixing unit configured to heat and fix, onto a recording material, an unfixed image formed on the recording material;

a first temperature detection element configured to detect a temperature of one end region in the fixing unit where a standard recording material does not pass that has a smallest width and is available for the apparatus;

a second temperature detection element configured to detect a temperature of another end region in the fixing unit;

a first fan configured to cool the one end region by starting to be driven when the temperature detected by the first temperature detection element reaches a cooling starting temperature;

a second fan configured to cool the other end region by starting to be driven when the temperature detected by the second temperature detection element reaches a cooling starting temperature;

a first shutter configured to change a width to be cooled by the first fan; and a second shutter configured to change a width to be cooled by the second fan, the second shutter moves in conjunction with the first shutter, wherein the apparatus is configured to drive the first and second shutters according to a size of the recording material to change the widths to be cooled by the first and second fans; and wherein when the temperature detected by the second temperature detection element is within a temperature range lower than the cooling starting temperature and if the temperature detected by the first temperature detection element reaches the cooling starting temperature, the first fan starts driving at a first rotation speed and the second fan starts driving at a second rotation speed lower than the first rotation speed.

7. The image fixing apparatus according to claim 6, wherein the first rotation speed is set according to at least one of a size of the recording material and a current flowing through a heater in the fixing unit.

8. The image fixing apparatus according to claim 6, wherein the second rotation speed is set according to movement amounts of the shutters.

9. The image fixing apparatus according to claim 6, wherein the first and second shutters starts moving so as to open an air flowing opening when at least one of the first and second temperature detection elements detects the cooling starting temperature.

10. The image fixing apparatus according to claim 6, wherein the fixing unit includes a cylindrical film and a heater in contact with an inner surface of the film, and wherein the first and second temperature detection elements detects a temperature of the heater.

* * * * *